United States Patent [19]

Jaunin

[11] 4,232,384

[45] Nov. 4, 1980

[54] TIMESETTING ARRANGEMENT FOR ELECTRICAL TIMEPIECES

[75] Inventor: Jean-Pierre Jaunin, Nidau, Switzerland

[73] Assignee: Societe Suisse pour l'Industrie Horlogere Management Services S.A., Bienne, Switzerland

[21] Appl. No.: 969,046

[22] Filed: Dec. 13, 1978

Related U.S. Application Data

[63] Continuation of Ser. No. 766,659, Feb. 8, 1977, abandoned.

[30] Foreign Application Priority Data

Feb. 23, 1976 [GB] United Kingdom ..... 7023/76

[51] Int. Cl.[3] ..... G04B 17/12; G04C 9/00

[52] U.S. Cl. ..... 368/185; 368/188

[58] Field of Search ..... 58/4 A, 23 R, 34, 35 R, 58/36, 50 R, 85.5, 63

[56] References Cited

U.S. PATENT DOCUMENTS

| | | | |
|---|---|---|---|
| 3,852,951 | 12/1974 | Sauthier | 58/23 R |
| 3,901,022 | 8/1975 | Cleusix et al. | 58/85.5 |
| 3,928,959 | 12/1975 | Maito | 58/23 R |
| 3,953,964 | 5/1976 | Suppa et al. | 58/50 R |
| 3,988,597 | 10/1976 | Tamaguchi | 58/23 R X |
| 3,994,124 | 11/1976 | Fujita | 58/23 R |
| 4,030,283 | 6/1977 | Sauthier et al. | 58/23 R |
| 4,059,955 | 11/1977 | Prak | 58/23 R |
| 4,067,187 | 1/1978 | Sekiya et al. | 58/23 R |

*Primary Examiner*—Vit W. Miska

*Attorney, Agent, or Firm*—Griffin, Branigan & Butler

[57] ABSTRACT

An electrically driven timepiece has a high frequency oscillator, a frequency divider and a time display capable of displaying at least minutes and seconds wherein correcting and setting of the display is obtained by means of a single user accessible switch capable of assuming at least two positions including a neutral and an active position and a sequential discriminator circuit which includes a plurality of memory devices, a timing chain and a bistable circuit controlled by the switch so that cycles of impulses applied to the switch within predetermined time periods by the user will result in the addition of a unit count to the seconds display or the blocking of the display advance or the driving of the display at a higher than normal rate in accordance with the cycle pattern employed.

8 Claims, 4 Drawing Figures

| 1 | 2 | 3 |
|---|---|---|
| 0 | 0 | 1 |
| 0 | 1 | 1 |
| 1 | 0 | 1 |
| 1 | 1 | 0 |

TIMESETTING ARRANGEMENT FOR ELECTRICAL TIMEPIECES

This is a continuation of application Ser. No. 766,659, filed Feb. 8, 1977, abandoned.

BACKGROUND OF THE INVENTION

During the past several years electrical timepieces have become increasingly popular with the result that numerous types and styles have been developed. In many of the present day timepieces the basic determination of frequency is by means of a high frequency crystal resonator controlling an oscillator. The output of the oscillator is passed through a frequency divider to produce a sequence of pulses of low frequency suitable for driving a display arrangement. Such display arrangements may either employ time indicating hands or comprise a digital display which in turn may employ a passive material or an active material.

In general, the pulse output from the final stage of the frequency divider is such as to apply one pulse each second to the display. Where a classic type of display is used the pulse sequence controls a stepping motor and through the stepping motor a series of gears whereby seconds, minutes, hours and eventually the date may be displayed. In the case of digital timepieces further registers are required and the frequency of the output is further divided in order to provide signals corresponding to seconds, minutes, hours and, where desired, the date. The outputs of these various registers are finally transmitted to a decoding arrangement whereby the display may finally be activated by the decoded signals.

In all of these various types of electronic timepieces a persistent problem arises when it comes to setting and correcting time as displayed. Moreover, since such timepieces are generally reputed to have a very high degree of precision it becomes intolerable to the user thereof that the time as displayed should show discrepancies with official time signals. Thus, means must be provided permitting easy corrections and alterations of the display. For instance, where the owner of the watch may cross time zones it is desirable to be able to reset the hour display without in any way disturbing the remaining displays. Finally, even where one is primarily concerned with timepieces of the electromechanical type it is desirable, where possible, to replace strictly mechanical arrangements for timesetting and correcting by suitable electric circuits which, in general, are easier to implement and may in the long run turn out to be more reliable.

In British specification No. 1,399,024 there has been described an electronic correction circuit for use in timepieces which permits easy correction of the seconds display. This is effected by means of a push-button which for each activation thereof adds one second to the display. Should, however, the user wish to remove or in effect, subtract seconds in the case where the time displayed is in advance of the correct time, the same push-button is maintained depressed over a predetermined period of time and whereas the initial impulse given thereby adds one second to the display, thereafter the display is stopped for as long as the push-button is maintained depressed.

This arrangement, although useful, provides only mechanical means for general time setting. A subsequent proposal was therefore set forth in British specification No. 1,434,443 in which a switching circuit was provided to enable the user by activation thereof to switch a much higher frequency from the divider circuit to the display, whereby the minutes display would be advanced at a very much higher rate. In that specification, moreover, there was described a mechanism for correcting the hour hand (and calendar if provided), without disturbing the other portions of the display. No arrangement was shown for correction of seconds.

SUMMARY OF THE INVENTION

The present invention combines the advantages of both these earlier specifications through use of a single control switch which may conveniently be in the form of a crown occupying the normal position, and which may correct either seconds or minutes in accordance with a predetermined cycle of activation of the switch. The same switch may likewise be arranged in the case of electromechanical timepieces as in the previously mentioned specification no. 1,434,443 to correct hours, that is to say provide a mechanical correction of the hour hand as well as correction of a calendar display should the latter be provided.

The invention accordingly provides an electrically driven timepiece having a high frequency oscillator, a frequency divider and a time display capable of displaying at least minutes and seconds wherein correcting and setting of the display is obtained by means of a single user accessible switch capable of assuming at least two positions including a neutral and an active position and a sequential discriminator circuit which includes a plurality of memory devices, a timing chain and a bistable circuit controlled by the switch so that cycles of impulses applied to the switch within predetermined time periods by the user will result in the addition of a unit count to the seconds display or the blocking of the display advance or the driving of the display at a higher than normal rate in accordance with the cycle pattern employed.

Where the user wishes to correct only the seconds display by the addition of unit counts thereto he simply presses in the crown of the watch and for each unit count he will effect one depression. The depression must be followed by a quick release since, should the user wish to stop the display and thus, in effect, remove seconds, he acts as described in British specification no. 1,399,024 which is to say he pushes in the crown and holds it in whereby at first one second is added and thereafter the display is stopped and the counters reset to zero.

Should, however, the user wish to advance the minutes display by electronic means, it is desirable that this be proceeded with at a much faster rate. Accordingly, the circuits within the present timepiece are so arranged that the user in order to effect the rapid advance pushes in the crown, holds it depressed during a predetermined period, releases it and immediately depresses it once again. Owing to the particular circuits as will be hereinafter described this switches a high frequency stage of the frequency divider to the display whereby the latter is advanced at a much faster rate. This rapid rate of advance continues for as long as the crown continues to be pressed.

BRIEF DESCRIPTION OF THE DRAWINGS

For a better understanding of the invention reference will now be made to the accompanying drawings in which FIG. 1 comprises a basic block outline of the arrangement according to the invention.

DETAILED DESCRIPTION OF THE INVENTION

Figure 1:
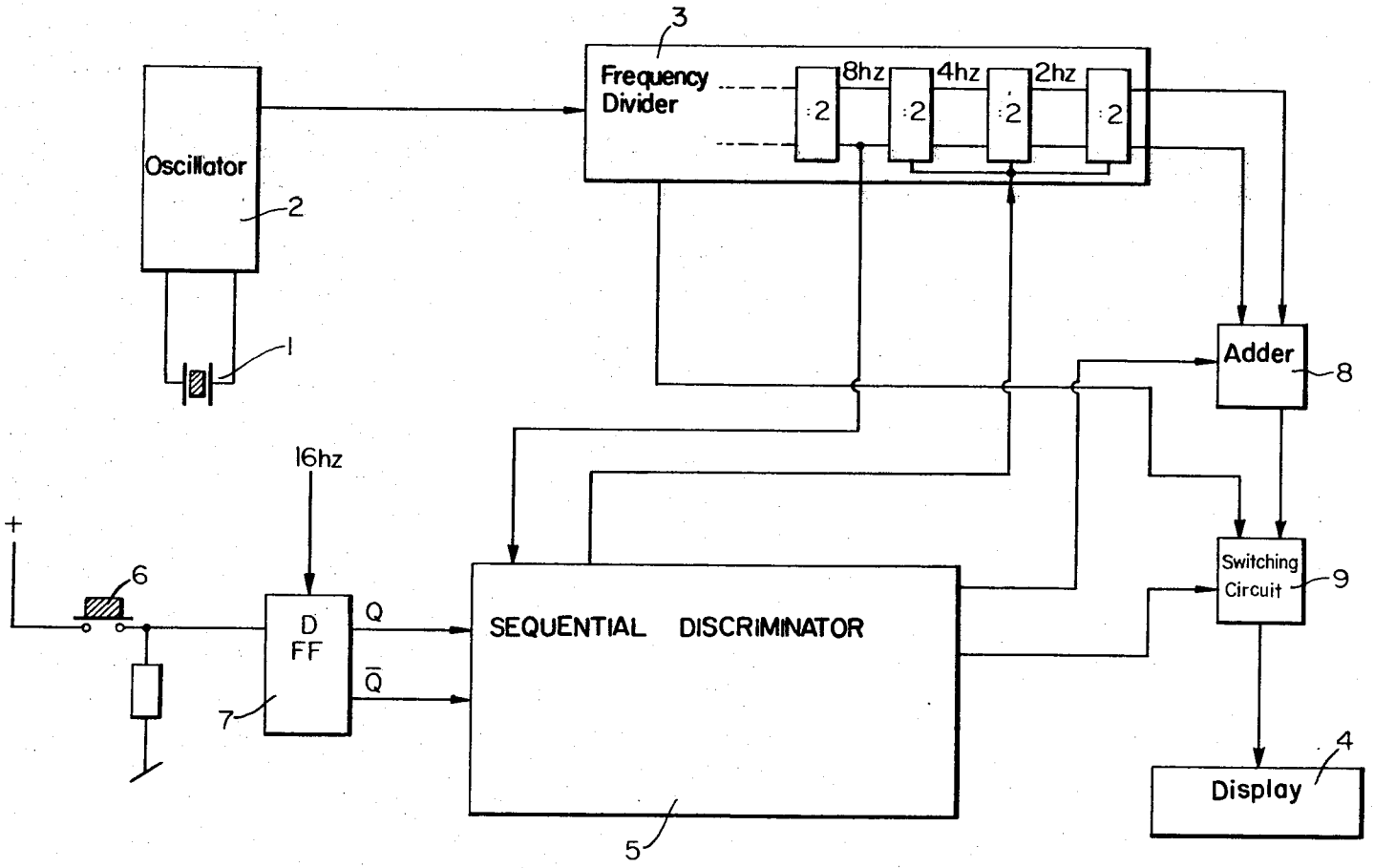

FIG. 1 shows the basic arrangement to be found in virtually all quartz crystal controlled timepieces. Herein quartz crystal 1 is used to control oscillator 2 which may provide outputs at a high frequency, for example 32768 Hz. This high frequency is transmitted to a frequency divider 3 which through a chain of binary circuits progressively reduces the frequency down to 1 Hz or lower for example which final frequency may be utilized to drive display 4. Various other blocks are shown in FIG. 1 the purpose of which will be subsequently set forth in some detail. Of these additional blocks there will be noted initially block 5 which comprises a discriminator circuit for sequences and which will be thus referred to as a sequential discriminator. In effect, this circuit is provided with logic enabling it to distinguish between various cycles of pulses which may be applied by means of control switch 6 operable by the user to set flip-flop 7. The sequential discriminator 5 may receive signals moreover from the frequency divider 3 and provides control signals to the frequency divider, the adder circuit 8 and the switching circuit 9. The various timing and memory circuits within the sequential discriminator 5 enable output of signals such that a signal applied to adder circuit 8 causes a single unit count to be transmitted to the display 4. A further output of the sequential discriminator 5 is applied to the switching circuit 9 whereby this may be enabled to transmit signals either from adder 8 or from a higher frequency stage of the frequency divider 3.

Figure 2:
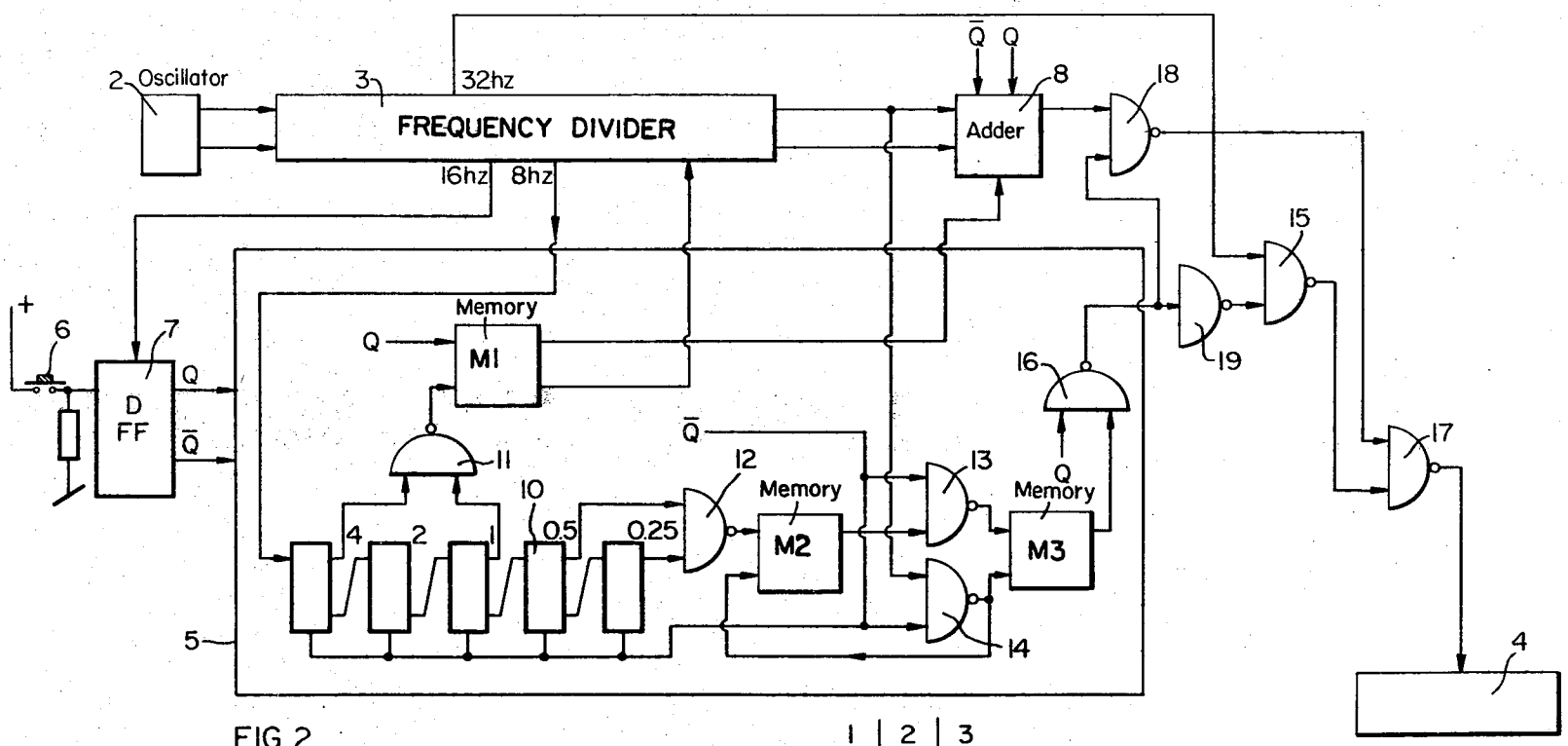
FIG. 2 comprises an expanded detail showing of a portion of the diagram of FIG. 1.
Figure 3A:
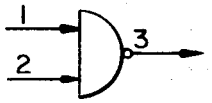
FIG. 3A is a truth table for the NAND-gates as shown.
Figure 3:
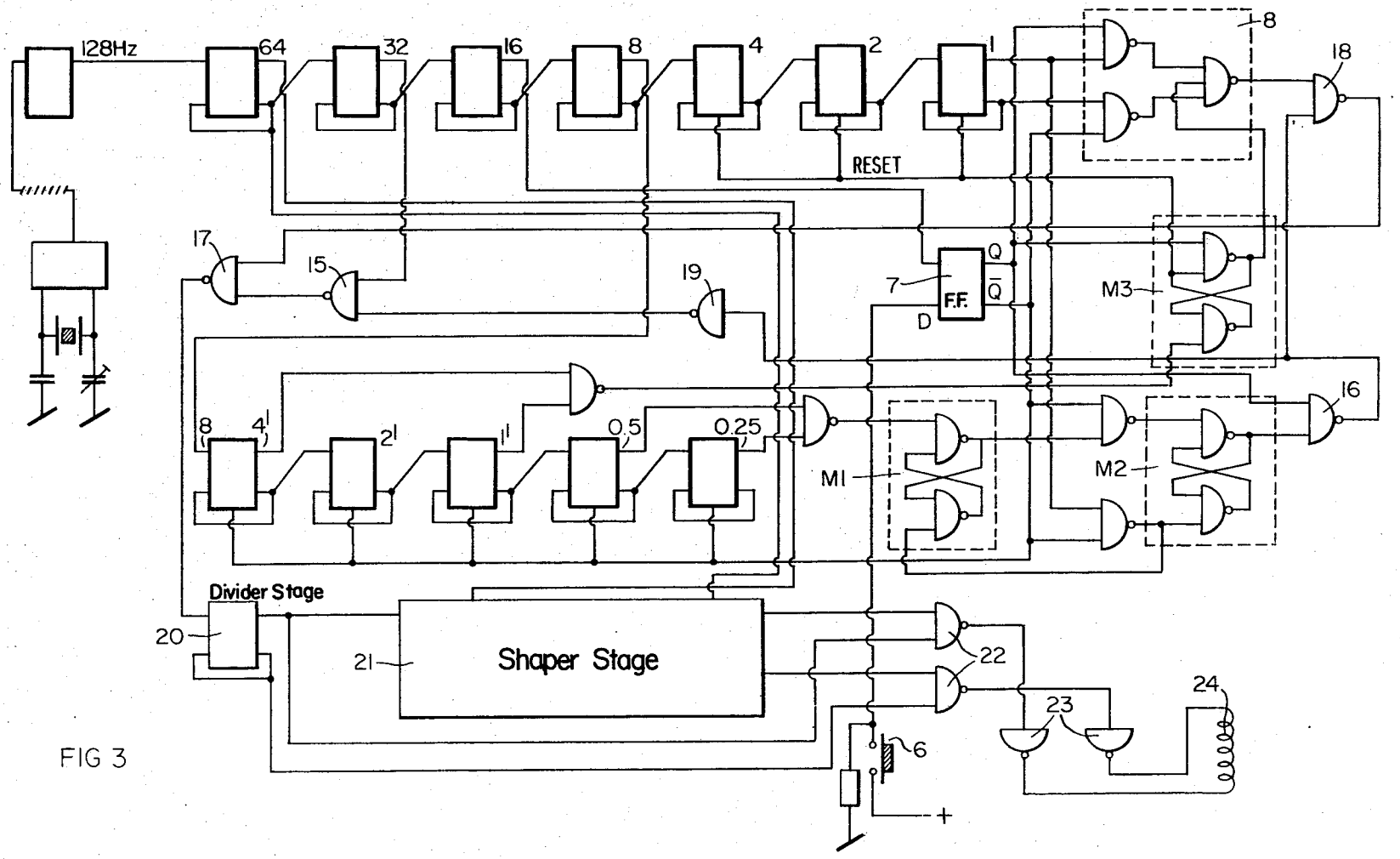
FIG. 3 is a much greater detail showing of the circuit as proposed by the invention, such as might be specifically applied to an electromechanical timepiece.

Consider next the detailed arrangements as shown in FIGS. 2 and 3. In FIG. 2 may be seen a somewhat simplified version of the internal logic in the sequential discriminator shown as block 5 in FIG. 1. Other details to be found in FIG. 2 are mainly similar to those already described in conjunction with FIG. 1. Thus, within block 5 as shown in FIG. 2 there will be noted initially a series of five binary stages which constitute an additional frequency divider 10. These stages receive as input an 8 Hz output from the frequency divider 3 and thus provide respectively outputs of 4, 2, 1, 0.5 and 0.25 Hz. Effectively, these five stages connected together constitute a timing chain. The outputs of stages having 4 and 1 Hz are gated together in NAND-gate 11 and the outputs of stages having 0.5 and 0.25 Hz are gated together in NAND-gate 12. NAND-gate 11 has its output applied to set a memory $M_1$ whereas NAND-gate 12 is arranged to set a memory $M_2$. Memory $M_2$ in turn is arranged to set a memory $M_3$ via a network of NAND-gates 13 and 14. The output of memory $M_3$ is applied to NAND-gate 16 the output of which selects outputs to the display. The output of memory $M_1$ is used to effect certain blocking and resetting operations as will be subsequently described.

Consider next the operation of the arrangement as shown in FIG. 2. Under normal operation of the timepiece the output of oscillator 2 is applied to frequency divider 3, the output of which via adder 8 and gate 17 goes to the display 4. Should the switch 6 be actuated and thereafter released the effect will be to produce a Q-signal on the output of D flip-flop 7, and to suppress the $\overline{Q}$-output signal. The removal of the $\overline{Q}$ signal enables the individual counter stages in the timing chain 10 to commence counting upon receipt of the first pulse from the 8 Hz output from the frequency divider 3 and blocks NAND-gates 13 and 14.

The application of the Q signal to adder 8 will cause the injection of an additional pulse into the adder and this pulse will subsequently pass to the output and thus to the display 4. One pulse only is added for each actuation of the switch 6 and it will be appreciated that should the switch be maintained actuated beyond a certain period of time the stages indicated as 4 and 1 of the timing chain will cause the NAND-gate 11 in conjunction with signal Q to change the condition of memory $M_1$ whereby a reset signal is applied to certain stages within the frequency divider 3 and an inhibit signal is applied to the adder 8. The stages which may thus be reset for example could be the last three stages as illustrated particularly in FIG. 3.

It will thus be realized that by actuating and releasing switch 6 that a single count will be added to that shown by the display 4. Should, however, the switch 6 be actuated for a sufficiently long period of time, namely about 600 ms in accordance with the outputs gated from the timing chain 10 then certain stages of the divider 3 will be reset and further transmissions of signals to the display will be blocked. It thus becomes possible to synchronize a timepiece simply by:

(a) adding pulses successively thus stepping the seconds display successively ahead one pulse at a time, (b) holding the switch 6 engaged thereby adding initially a single count to the display and thereafter blocking transmission of signals to the display.

Assuming, however, that the switch has been engaged for a period of time sufficiently long ($\geqq 3$ seconds) it is clear that eventually all stages of the timing chain 10 will be actuated whereby outputs will likewise be available from the last two stages shown as having outputs at 0.5 Hz and 0.25 Hz. Accordingly, NAND-gate 12 will provide an output whereby memory $M_2$ changes state and an enabling output is then available to NAND-gate 13. Since, however, the $\overline{Q}$ signal at this time is not present memory $M_3$ remains in its initial state.

In the event now that switch 6 is simply released it will be seen that the $\overline{Q}$ signal once again becomes available whereby memory $M_3$ initially changes state, but thereafter immediately along with memory $M_2$ reverts to its initial state. The now present signal $\overline{Q}$ furthermore resets all stages in the timing chain 10 which in turn via NAND-gate 11 resets memory $M_1$ to its initial state, in the absence of Q.

If, however, instead of simply releasing switch 6 following the setting of memory $M_2$ this should be released and quickly reengaged the sequence of events will change considerably. Thus, the quick release will, as already noted, have resulted in setting memory $M_3$ via NAND-gate 13 bearing in mind that the release switch 6 will cause reappearance of signal $\overline{Q}$. The rapid reengagement of switch 6 following setting of memory $M_3$ does not give sufficient time for NAND-gate 14 to receive the signal coming from the frequency divider 3 at $\frac{1}{2}$ Hz intervals and thus the reset signal does not apply to memory $M_3$ or to memory $M_2$. At the same time the Q signal once again available from the D flip-flop 7 in conjunction with the output from memory $M_3$ is applied to NAND-gate 16 which thereafter places an inhibit signal on NAND-gate 18, is inverted in inverter 19 and thus enables NAND-gate 15 to transmit a 32 Hz series of signals from the frequency divider 3 to the display via NAND-gate 17. This latter signal may be continued as long as the switch 6 continues to be actuated. Following release of the switch, however, the $\overline{Q}$ signal becomes once again available and the several memories as well as the frequency divider chain are all reset as in the previous instance. Thus the output from memory $M_1$ which goes to inhibit the adder 8 and resets certain stages within the frequency divider 3, is no longer present and the normal sequence of events may once again be restored. It will be realized that the resetting of memory $M_3$ will block NAND-gate 16 which then provides an enable signal to NAND-gate 18 and via inverter 19 provides a blocking signal to NAND-gate 15. Thus, the normal sequence of output signals from the frequency divider 3 will once again be transmitted to the display 4.

No basic differences exist between FIG. 2 and FIG. 3 other than the fact that certain additional details are to be found in FIG. 3 and furthermore this latter version of the invention has been specifically designed to be applicable to a timepiece utilizing a stepping motor and time displaying hands. The output of gate 17 (also in FIG. 3) is passed through a further divider stage 20 which reduces the frequency to either 0.5 Hz or 16 Hz in accordance with the input applied thereto from NAND-gate 17. The output of stage 20 is transmitted via pulse shaper stage 21 to NOR-gate 22 and from thence via NAND-gates 23 to the winding of stepper motor 24. Since the details of pulse shaper 21 are in themselves conventional and do not form part of the present invention they are neither specifically shown nor described. It is sufficient to note that such a pulse shaper stage determines the length of the impulses applied to the motor and for this may receive outputs from the frequency divider 3.

It will be clear from the preceding description that an arrangement has been provided applicable to time setting and correcting in timepieces which permits the application of numerous variations whilst at the same time conserving a basic mechanical simplicity. Thus, it will be realized that by adopting a switch arrangement as shown for instance in British patent specification 1,434,443 as previously referred to it is possible to obtain various corrections from a single user accessible organ. Stem and crown arrangements shown in the earlier filed patent application permit in one position the correction of an hour hand indication in a conventional analogue display type timepiece as well as calendar corrections, whereas depressing the same crown permits a rapid correction of the seconds and hence the minutes indication or alternately addition of single unit counts to the seconds display. Although this specific example as shown in FIG. 3 has dealt with a type of timepiece utilizing a quartz as frequency standard and an electromechanical type of display arrangement it is clear from the nature of the invention that the correction arrangements as disclosed herein could be equally applied to digital type displays as embodied for instance in the now well-known digital timepieces employing liquid crystals or light emitting diodes.

Other variants are of course possible, as for instance with the same basic circuits but with slightly different timing arrangements one can provide for the addition of two unit counts to the seconds following by a reset or other combinations of function changeover. It becomes clear moreover that through the addition of further memories one could provide equally for certain corrections such as hour display in an electronic manner.

In order that the user be able to keep track of what has taken place it could be foreseen to employ a display (LCD or LED for example) wherein the sequence of steps would be shown to better enable the user to proceed in the correct manner. Accordingly, the utilization of memories such as shown within the circuit of the sequential discriminator permits many possibilities whilst at the same time enabling a limitation to relatively simple mechanical switching means. Thus, a timepiece so equipped may be expected to have many sophisticated features provided at minimum cost.

What I claim is:

1. An electrically driven timepiece including:

a high frequency oscillator means for producing pulses of a predetermined frequency;

a frequency-divider/pulse-transmission means, including a frequency divider, connected to said high frequency oscillator means for dividing said pulses of said predetermined frequency into display actuating pulses of a display-actuating frequency and transmitting the pulses to a time display means;

a time display means including at least minute and second displays connected to said frequency-divider/pulse-transmission means for receiving said display-actuating pulses and for advancing said minute and second displays in response thereto, said time display means including a stepping motor arranged to drive time displaying hands;

a single user-accessible switch for correcting and setting the display, said switch being capable of assuming at least two positions including a neutral and an active position;

a sequential-discriminator/memory circuit means connected between said switch and said frequency-divider/pulse-transmission means for generating combinations of controls in response to time cycle patterns with which the single switch is moved between the neutral and active positions, a first such control being the insertion of a pulse into the frequency divider transmission means for each movement of said switch from said neutral position to said active position, a second such control blocking transmission of pulses by the frequency-divider/pulse-transmission means to prevent advancement of the displays in response to the switch being held in the active position for a predetermined length of time, and a third such control operating on the frequency-divider/pulse-transmission means to increase the rate at which pulses are transmitted to the time display to thereby advance the displays at a faster than normal rate in response to the switch being held in the active position for a predetermined length of time, and thereafter being moved to the neutral positon and quickly returned to the active position.

2. An electrically driven timepiece as set forth in claim 1 wherein the sequential-discriminator/memory circuit means includes a timing chain comprising a multi-stage binary counter said timing chain being linked to said switch for timing the length of time said switch is in the active position to determine the time cycle pattern with which said switch is moved between said neutral and said active positions.

3. An electrically driven timepiece as set forth in claim 2, wherein said sequential-discriminator/memory circuit means includes a first memory connected to the counter to be actuated when a first count is reached and a second memory connected to the counter to be actuated when a second count is reached to aid in determining the time cycle pattern with which said switch is moved between said neutral and said active positions.

4. An electrically driven timepiece as set forth in claim 3 wherein the first memory has its output connected to certain stages of the frequency divider of the frequency-divider/pulse-transmission means and to a blocking circuit of the frequency-divider/pulse-transmission means whereby attainment of the first count resets said certain stages and blocks transmission of signals from said stages to the time display means.

5. An electrically driven timepiece as set forth in claim 3 wherein said electrically driven timepiece includes a bistable circuit connected between said switch and said sequential-discriminator/memory circuit means for producing signals of first and second states corresponding to the neutral and active positions of said switch, said second memory having its output connected via a gating network to the input of a third memory, the gating network being arranged to receive signals from the switch controlled bistable circuit, the arrangement being such that movement of the switch between said neutral and active positions within a predetermined time interval, and in the presence of an output signal from the second memory results in actuation of the third memory.

6. An electrically driven timepiece as set forth in claim 5, wherein the third memory has its output coupled to a first gate which blocks transmission of signals from the final stage of said frequency divider of the frequency-divider/pulse-transmission means to the time display means and to a second gate which enables transmission of higher frequency signals from an intermediate stage of the frequency divider to be transmitted to the time display means.

7. An electrically driven timepiece as set forth in claim 3 wherein said sequential-discriminator/memory circuit means includes a memory means connected between said timing chain and said frequency-divider/-pulse-transmission means for blocking pulses in the frequency-divider/transmission means to prevent advancement of the displays in response to said timing chain measuring a first time period after movement of said switch from said neutral to said active position.

8. An electrically driven timepiece as set forth in claim 3 wherein said memory means has the further function of enabling transmission of higher frequency signals from an intermediate stage of the frequency divider to the time display means in response to said timing chain measuring a second time period longer than said first time period, and thereafter said switch being moved to said neutral position and quickly returned to the active position.

* * * * *

UNITED STATES PATENT AND TRADEMARK OFFICE

CERTIFICATE OF CORRECTION

PATENT NO. : 4,232,384

DATED : November 4, 1980

INVENTOR(S) : Jean-Pierre Jaunin

It is certified that error appears in the above-identified patent and that said Letters Patent are hereby corrected as shown below:

Column 8, line 13, change "3" to --2--;
line 22, change "3" to --7--.

Signed and Sealed this

Second Day of June 1981

[SEAL]

Attest:

RENE D. TEGTMEYER

Attesting Officer

Acting Commissioner of Patents and Trademarks